US007723596B2

(12) United States Patent
Kelly

(10) Patent No.: US 7,723,596 B2
(45) Date of Patent: May 25, 2010

(54) STABILIZING HOLDER FOR SENSORY DEVICE

(76) Inventor: Jeffery Kelly, 5100 Jacquelyn Dr., Lincoln, NE (US) 68516

( * ) Notice: Subject to any disclaimer, the term of this patent is extended or adjusted under 35 U.S.C. 154(b) by 0 days.

(21) Appl. No.: 11/767,232

(22) Filed: Jun. 22, 2007

(65) Prior Publication Data

US 2007/0295189 A1 Dec. 27, 2007

Related U.S. Application Data

(60) Provisional application No. 60/805,702, filed on Jun. 23, 2006.

(51) Int. Cl.
*G10D 9/00* (2006.01)

(52) U.S. Cl. ..... 84/421; 84/453

(58) Field of Classification Search ..... 84/421, 84/725, 290, 453

See application file for complete search history.

(56) References Cited

U.S. PATENT DOCUMENTS

| | | | | |
|---|---|---|---|---|
| 3,743,059 | A | 7/1973 | Morse et al. | |
| 4,068,742 | A | 1/1978 | Resare | |
| 4,086,984 | A | 5/1978 | Johansson | |
| 4,134,309 | A | 1/1979 | Balke et al. | |
| D251,908 | S | 5/1979 | Fujita | |
| D251,970 | S | 5/1979 | Fujita | |
| 4,194,096 | A | 3/1980 | Ramsey | |
| 4,201,107 | A | 5/1980 | Barber, Jr. et al. | |
| 4,242,937 | A * | 1/1981 | Pozar | 84/725 |
| 4,257,495 | A | 3/1981 | de Brie Perry | |
| 4,396,807 | A | 8/1983 | Brewer | |
| 4,514,598 | A | 4/1985 | Plice | |
| 4,546,950 | A | 10/1985 | Cech | |
| 4,577,541 | A | 3/1986 | Edge | |
| 4,745,839 | A | 5/1988 | Peraino | |
| 4,790,228 | A | 12/1988 | Thirion | |
| 4,791,674 | A | 12/1988 | Drever | |
| 4,937,877 | A | 6/1990 | Pocock et al. | |
| 4,941,389 | A | 7/1990 | Wendler | |
| 4,943,798 | A | 7/1990 | Wayne | |
| 4,991,220 | A | 2/1991 | Wolf | |
| 5,010,803 | A | 4/1991 | Donnell | |
| 5,031,872 | A | 7/1991 | Vance et al. | |
| 5,042,356 | A | 8/1991 | Karch | |
| 5,088,376 | A | 2/1992 | Crago et al. | |
| 5,105,710 | A | 4/1992 | Rothmel | |
| 5,107,741 | A | 4/1992 | Beals et al. | |
| 5,138,666 | A | 8/1992 | Bauer et al. | |
| 5,194,686 | A | 3/1993 | Winkler | |
| 5,233,898 | A | 8/1993 | Montano | |
| 5,301,591 | A | 4/1994 | Greenberg | |
| 5,353,674 | A | 10/1994 | Volpp | |

(Continued)

*Primary Examiner*—Jianchun Qin
(74) *Attorney, Agent, or Firm*—David H. Milligan; Sean P. Connolly; Husch Blackwell Sanders LLP

(57) ABSTRACT

A holder for mounting a sensory device to a musical instrument includes a bracket having a plurality of first connector elements, a locking mechanism for fixing the sensory device to the bracket; and a plurality of hanger members. The bracket supports the sensory device and each of the hanger members connects at least one of the first connector elements to at least one of a plurality of second connector elements attached to the musical instrument. The second connector elements being spaced apart from each other and the hanger members hold the bracket at a predetermined position.

41 Claims, 10 Drawing Sheets

U.S. PATENT DOCUMENTS 5,371,804 A 12/1994 Bauer
5,375,500 A 12/1994 Halpin
5,428,688 A 6/1995 Becker et al.
5,430,245 A 7/1995 Rogers
5,463,693 A 10/1995 Birli et al.
5,492,047 A 2/1996 Oliveri
5,574,236 A * 11/1996 Webber ..... 84/411 M
5,581,030 A 12/1996 Conroy
5,602,354 A 2/1997 Martin
5,606,142 A 2/1997 Volpp
5,692,060 A 11/1997 Wickstrom
5,877,440 A 3/1999 Chaffee et al.
5,988,585 A 11/1999 Eaton
6,121,528 A 9/2000 May
6,172,289 B1 1/2001 Shelley
6,424,723 B1 7/2002 Jing
6,441,292 B1 8/2002 Donnell
6,459,802 B1 * 10/2002 Young ..... 381/368
6,573,441 B2 6/2003 Norris, Jr.
6,614,911 B1 9/2003 Watson et al.
RE38,350 E 12/2003 Godfrey
6,724,904 B1 4/2004 Winter
6,757,400 B1 6/2004 Cheng
6,794,569 B2 9/2004 Kamijima et al.
6,882,734 B2 4/2005 Watson et al.
6,891,097 B2 5/2005 Wilfer
D506,918 S 7/2005 Nakajima
6,922,475 B2 7/2005 Hsieh
6,925,880 B1 8/2005 Roberts
6,927,330 B2 8/2005 May
7,013,017 B2 3/2006 Pavlovic
7,013,492 B2 3/2006 Hugh et al.
7,015,391 B2 3/2006 Tomoda
7,017,870 B2 3/2006 Meyer
7,038,117 B2 5/2006 Yoshino

* cited by examiner

STABILIZING HOLDER FOR SENSORY DEVICE

CROSS-REFERENCE TO RELATED APPLICATION

This application claims the benefit of and priority to U.S. Provisional Patent Application No. 60/805,702, filed Jun. 23, 2006, entitled STABILIZING HOLDER FOR SENSORY DEVICE, which document is hereby incorporated by reference to the extent permitted by law.

BACKGROUND OF THE INVENTION

The present invention relates generally to holding devices, and more particularly to an improved holding device used for holding a sensory device, such as microphones, for use on musical instruments such as drums.

Acoustical drums have long been an integral part in musical groups and performances.

Various types of sensory devices have been affixed to acoustical drums to measure, enhance, record, and/or monitor different aspects (e.g., sound, images, temperature, humidity, light-level, etc.) associated with an acoustical drum or the environment corresponding to the acoustical drum.

For example, in some cases, it is desirable to electrically amplify a drum's sound to obtain an increased level of volume and/or sound characteristics. This often involves placing a microphone in close proximity to the drum. The signal produced by the microphone is usually sent to an external speaker by means of a cord. More recently, in some cases, a radio transmitter located in or attached to the microphone transmits a signal which is sent to a receiver which in turn is connected to the amplification system. In either case, the microphone needs to be supported by a mechanical means to obtain proper placement of the microphone to the drum.

Previously, the use of a microphone stand comprised of a weighted base or other means of support, a vertical shaft and in some cases, an additional horizontal boom assembly atop the vertical shaft, and a clip to hold the microphone in place.

These stands have several disadvantages. For example, the stands can transfer vibrations from the floor or stage set. These stands also can transfer vibrations through the support and vertical shaft of the microphone stand. All of these vibrations can be transferred onto the microphone itself. These vibrations can cause the microphone to produce an unwanted signal. The vibrations can also cause unwanted activation of sound capturing devices attached to the microphone.

Another disadvantage is that limited space may also present a problem for placement of the numerous microphone stands needed to amplify various drums at once, as in the case of a drum set. Bass drums of these drum sets are routinely amplified by means of a support base, vertical shaft and horizontal boom assembly which houses the microphone on one end and a counter-weight on the other end. The microphone is then adjusted to face the bass drum or placed partially inside the drum, through an opening created in the front drumhead. The weight of the typically large microphones frequently used for amplifying bass drums require the counter-weight to extend beyond the vertical plane of the front of the bass drum. This placement creates a trip hazard for other musicians. This placement also increases the likelihood of accidentally displacing the microphone due to the outwardly extending boom and counter-weight assembly. The additional space required to place the microphone stand on the floor in front of the bass drum, also requires additional floor space in front of the bass drum which may not be available, as in the case of the drums being set up on an elevated platform.

Another disadvantage is that the time and effort spent in assembling the above devices, outfitting them with the microphones, achieving the proper placement and alignment of the microphone, and connecting them to the amplification system is often considerable.

There have been various efforts made to affix the drum microphones directly inside the drum in the past. One previous effort is disclosed in the "Electroacoustically amplified drum and mounting bracket", by Randall May, in U.S. Pat. Nos. 4,168,646, 4,570,522, 6,121,528. The aforementioned effort consists of a microphone mounting bracket which is installed on the inside of the drum, using the pre-existing drum hardware mounting fasteners as means of attachment. This effort has several disadvantages. For example, the mounting bracket has the likelihood of transferring vibrations of the drum shell induced by the percussion of the musician's striking instrument against the striking surface of the drumhead, creating a possibly unwanted signal being sent by the microphone to the amplification system. Other disadvantages are that the aforementioned effort is also a semi-permanent installation, thereby making removal and replacement of the system somewhat of an inconvenience.

Another embodiment of the aforementioned patents to May requires the need to create a hole in the shell of the drum involved in the installation, to accept installation of an electrical connection device. This device is used to connect the internal microphone to the amplification system. At least one disadvantage of this embodiment is that the installation of the connection device may be undesirable to some owners and players of the instrument. Another aspect of the Randall May invention that has disadvantages is the distance adjustment available between the interior surface of the drum shell and the microphone mount. Being a rigid mounting bracket, the amount of adjustment range from the inside of the drum shell to the microphone itself is restricted and minimal at best.

Another effort at microphone placement on drums is disclosed in U.S. Pat. No. 5,574,236, entitled "Drum muffling and microphone suspension assembly", to Webber, Steven R. This effort is a device consisting of a drum baffle system with the option of installing a microphone mount, in which the said microphone mounting apparatus is suspended on a plurality of coil springs which are attached to the drum muffling assembly. This effort has several disadvantages. For example, the coil springs may create unwanted audio effects due to the individual coils of the springs striking one another. Another disadvantage is that the effort disclosed by Webber also requires the use of the drum baffle element to utilize the microphone holder, which eliminates the choice of the individual to use only the microphone mount by itself.

Another effort at microphone placement on drums is disclosed in U.S. Pat. Nos. 5,703,306 and 6,424,723, to Jing. Jing discloses a clamp or holder which is attached directly to the drum's tuning rim which supports the microphone in the desired position. This effort has several disadvantages. For example, this method may increase the risk of damage to the microphone by the impact of the drummer's striking instrument. This effort also requires additional time and effort to prepare the system for use.

BRIEF SUMMARY OF THE INVENTION

The present invention provides a means for support and positioning of a sensory device for use in a drum-type musical instrument. The invention utilizes a rigid central main mounting unit and a plurality of elastomer cords providing support of said main mounting unit. The main mounting unit accepts any variety of sensory devices (e.g., sound, images, temperature, humidity, light-level, etc.). For example, the main mounting unit accepts industry standard microphones, microphone clips and other devices. The elastomer cords attach the main mounting unit to one or more interior support hooks. Alternatively or in combination with the interior support hooks, the elastomer cords can also engage the pre-existing tuning lugs which are present in plurality around the outside circumference of the drum shell of most drum instruments. The elastomer cords can engage the main mounting unit by utilizing any of a series of holes located around the outside of the main mounting unit. The support provided by the elastomer support cords is sufficient to retain the main mounting unit in place, keeping the device totally isolated from the stage or floor, the drum shell and immediate surroundings.

One embodiment of the present invention provides an advantageous device for installing and utilizing a sensory device, microphone or other device in conjunction with a drum or series of drums.

Another embodiment of the present invention provides a device to save time and effort when preparing to amplify a drum or series of drums.

Another embodiment of the present invention provides a holder for mounting a sensory device to a musical instrument. The holder comprises a bracket having a plurality of first connector elements, a locking mechanism for fixing the sensory device to the bracket; and a plurality of hanger members. The bracket supports the sensory device and each of the hanger members connects at least one of the first connector elements to at least one of a plurality of second connector elements attached to the musical instrument. The second connector elements being spaced apart from each other and the hanger members hold the bracket at a predetermined position.

In one embodiment, the main mounting unit is internally mounted. In this embodiment, a plurality of hardware used for tensioning and tuning of the drum head is usually present on most musical drums. Typically, the tuning lug receivers are directly attached to the drum shell by means of a bolt from the inside out into the tuning lug receiver. The mounting hardware consists of a hook shaped configuration or a fully-closed loop assembly, combined with a length of flat strap which contains a hole to accept the drum's tuning hardware mounting bolt. The tuning hardware bolt is passed through the hole in the strap, which acts as a washer. The tuning hardware bolt affixes the hook or loop to the inside of the drum shell when replaced into its original position in the drum tuning receiver. One or more hooks or loops need be installed and utilized by the support cords, in any configuration chosen by the user, for the system to operate correctly inside the drum.

In another embodiment of the present invention, the main mounting unit is externally mounted. In this embodiment, a plurality of hardware used for tensioning and tuning of the drum head is usually present around the outside circumference of the drum shell. The tuning hardware typically consists of a tuning lug, a housing which engages the hoop, a retaining hoop and threaded receiver hardware which is mounted on the drum shell. Typically the tuning lugs have enough length of threaded area available to allow the addition of a spacer being added between the tuning lug and the housing which engages the hoop. Tuning and tensioning of the drumhead operate normally with the spacer installed however the spacer provides a means for the hook on the end of the support cords to engage around the spacer and tuning lug, as shown in the drawings. One or more of these spacers and support cords need be used for the system to operate properly. The microphone mounting assembly, as described in I.A. above, is installed according to the descriptions herein and the installation is complete.

In a further embodiment of the present invention, the elastomer support straps may be wrapped around the retaining hoop of the drum and engaged around the shaft of the tensioning lug by means of the hook or loop located at the end of the support cord or cords and at any available space naturally provided by the particular hardware being addressed. One or more of these spacers and support cords need be used for the system to operate properly.

Another embodiment of the invention provides a means for the invention to be installed inside the drum, which will retain the position and placement of the microphone and its components during transit of the drum or drums.

Another embodiment of the present invention provides a means for the invention to be mounted externally, on the end opposite the striking surface, being easily positioned and semi-concealed to allow for easy transport.

Another embodiment of the present invention provides a means for the invention to be mounted externally on various drums and types of drums.

Another embodiment of the present invention provides a means for an easily installed, removed and reinstalled sensory device, microphone or device mounting system.

Another embodiment of the present invention provides a means for supporting a sensory device, microphone or device in the desired position.

Another embodiment of the present invention provides a means for supporting a sensory device, microphone or device in many various positions simply by changing the length and/or strength of the elastomer support cords.

Another embodiment of the present invention provides a means to support a sensory device, microphone or device in or on virtually any conventional musical drum available.

Another embodiment of the present invention provides a means for supporting a sensory device, microphone or device within an assembly which isolates the main mounting unit and sensory device, microphone or device from external vibrations and erroneous signals being produced by the sensory device or microphone.

Another embodiment of the invention allows the user the ability to utilize various configurations of internal mounting options to obtain a detailed and accurate placement of the sensory device, microphone or device being supported by the invention.

Another embodiment of the present invention provides a means for amplifying a musical drum which can be left installed during transport, set-up, tear-downs and performances.

Another embodiment of the present invention provides a means for amplifying a musical drum which offers the simplicity of being ready to operate in a minimal amount of time.

Another embodiment of the present invention provides a means for amplifying a musical drum with options available to the individual user as to how he or she chooses to install and operate the system.

Another embodiment of the present invention provides a means for supporting a sensory device, microphone or device by means of including universal sizes and considerations.

Another embodiment of the present invention provides a means for supporting a sensory device, microphone or device in many different directions, distances and orientations.

Another embodiment of the present invention provides a means for installing and operating a sensory device, microphone or device inside a drum shell and allowing the signal cord to pass through the bottom, or batter head of the drum by means of a hole created in said drum head, which allows for connection to the amplification system.

Another embodiment of the present invention provides a means for installing and operating a sensory device, microphone or device inside a drum shell and allowing the signal cord to pass through the drum shell by means of a hole created in the shell, which allows for connection to the amplification system.

Another embodiment of the invention provides means for internal or external installation of a wireless sensory device, microphone or device and its transmitter, which can be wirelessly connected to receivers of the signal produced by the equipment and relayed to the amplification or recording system for further processing.

Another embodiment of the present invention provides a means for utilizing a sensory device, microphone or device support system which requires zero percent of available floor space to install and operate.

Another embodiment of the present invention provides a means for installing a sensory device, microphone or device support system with little or no alterations needing be done to the drum shell.

Another embodiment of the present invention provides a means for relocating the invention to other instruments quickly if need be.

Another embodiment of the invention provides a means for supporting a sensory device, microphone or device on various drums at once.

Another embodiment of the present invention provides a means for installing and operating a sensory device, microphone or device support system inside a drum shell and away from the threat of damage being done to the sensory device, microphone or device due to the strike or contact of the musician instruments.

Another embodiment of the present invention provides a means for installing and operating a sensory device, microphone or device support system inside a drum shell and out of sight to the audience and other select few.

Another embodiment of the present invention provides a means for installing and operating a sensory device, microphone or device support system which is able to be used with or without any chosen dampening material the drummer wishes to use.

Another embodiment of the present invention provides means for installing the main mounting unit which will not dramatically change the actual sound of the drum.

Another embodiment of the present invention optionally leaves the system intact even in the event the drums and devices are not connected to an amplification system.

Another embodiment of the present invention optionally allows using the main mounting unit in various situations like recording sessions, live performances and public or private gatherings.

Another embodiment of the present invention comprises a sensory device mounting system that will be easy to understand, install and use for anyone with little knowledge in miking and amplifying drums to those who are considered experts of the field.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein. Like numbers utilized throughout the various Figures designate like or similar parts or structure.

DETAILED DESCRIPTION OF THE INVENTION

Figure 1:
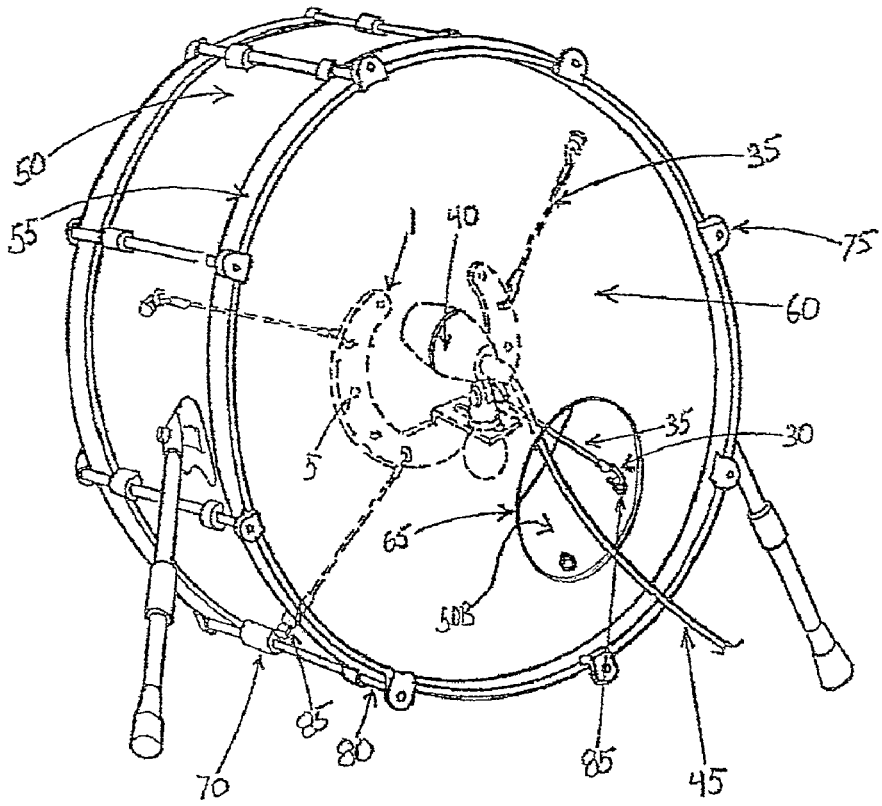
FIG. 1 is a perspective view of a drum and microphone with a holder for mounting the microphone constructed in accordance with one embodiment of the present invention.

FIG. 1 illustrates the present invention in one of its embodiments. The rigid central main mounting unit 1 may be constructed of any material with substantial strength to withstand the outward pressures exerted by the elastomer support cords 35. For example, the main mounting unit 1 may comprise aluminum, metal, steel, plastics, composite materials such as carbon fiber, strong woods and laminates of woods, or a combination thereof. A plurality of holes 5 are created around the outside edge 1A of the main mounting unit 1 to accept the attachment hooks or loops located on the ends of the support cords. The main mounting unit 1, with the sensory device 40 attached, is housed inside the drum shell 50. The main mounting unit 1 is supported inside the drum shell 50 by means of the elastomer cords 35. One end of the elastomer cords 35 engages the main mounting unit 1 by utilizing a hook 30 which is passed through the user's choice of holes 5 present in plurality around the circumference of the main mounting unit 1. The other end of the elastomer cord 35 and hook 30 engages into any of the loops 85 which are installed on the inside of the drum shell 50B. These loops 85 are held in place on the inside of the drum shell 50B by the drum's existing tuning hardware 70 screws or bolts. The sensory device's 40 signal transmission cable 45 passes through a port 65 which is present in the drumhead 60. The drumhead 60 is held in place on the drum shell 50 by means of friction between the tuning hoop 55 and the drum shell 50. The tuning hoop 55 is provided inward pressure by the hoop retainers 75 and tuning lugs 80, which are engaged by means of threads into the tuning hardware 70. The elastomer support cords 35 comprise materials comprising elastic and non-elastic properties and/or combinations thereof. For example, the elastomer support cords 35 comprise solid rubber products, a series of rubber strands, a series of rubber strands encased within a woven nylon outer covering, or a combination thereof.

A hook 30 is located at each end of the elastomer support cords 35. The hook 30 comprises a rigid material. For example, the hook 30 comprises aluminum, metal, steel, plastics, composite materials such as carbon fiber, strong woods and laminates of woods, or a combination thereof. Optionally, a loop, not shown, constructed of the same piece of elastomer cord is formed on the ends and secured in position. The loop may be secured in position by a metal squeeze clamp, heat or chemical adhesion, a nylon friction-engaged tie-strap, or a combination thereof. In either case, the hook 30, loop or combination of the two, located on the ends of the elastomer support cords 35 must be of sufficient size to engage the receiving holes 5 located on the main mounting unit 1, as well as engage in the hooks or loops 85 which are installed around the inside of the drum shell 50 by utilizing the fasteners and pre-existing tuning hardware located around the inside circumference of the drum, or to engage the drum's tuning lug hardware 85, located around the outside circumference of the said drum shell 50.

Figure 2:
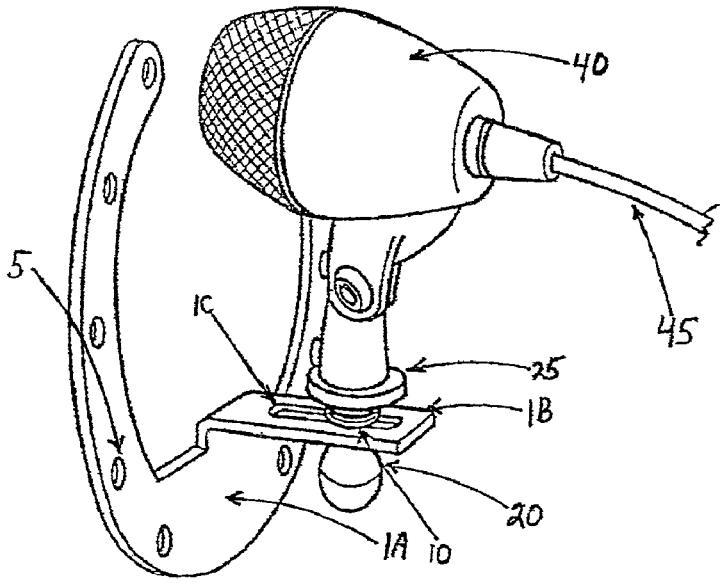
FIG. 2 is a perspective view of the microphone and holder for mounting the same in accordance with one embodiment of the present invention.

FIG. 2 illustrates an embodiment comprising the main mounting unit 1A and sensory device 40 with a signal transmission cable 45 connected. Located on the main mounting unit 1 is a mounting plate 1B of either the same piece of material, bent under pressure to 90 degrees or a separate piece of material attached to the main mounting unit 1 in the same position as the aforementioned horizontal extension is shown on the drawings. This mounting plate 1B contains a slot 1C utilized to affix the attachment hardware which is matched to the device to be supported, on either the top or the bottom of the mounting plate 11B. The slot 1C allows for movement of the threaded post 10 or other device receiver in a perpendicular direction to the main mounting unit 1. Most microphones, microphone clips, thread sizes and some other devices are standardized within the industry, however, the main mounting unit 1 may be affixed with any hardware the user chooses, as long as sufficient room exists for mounting the device without interfering with the operation of the mounting system. In most cases, the preferred attachment device would be a threaded post 10 having threads on one end and an area of extending material on the other, which is sized to fit the slot 1C in the horizontal extension mentioned in the previous section with sufficient clearance to move freely along the slot 1C. The end opposite the outside threads of the threaded post 10 is drilled a hole 100B in the center of the post 10, to accept a means of attachment by a bolt or screw which is sized to fit the threads in the end of the post. The threaded post 10 comprises a durable material. For example, the threaded post 10 comprises steel, composites, or a combination thereof. The sensory device 40 is mated with its appropriate mounting hardware 10, which is attached to the mounting tab 1B by utilizing friction provided by the thumbscrew 20. The slot 1C in the mounting tab 1B provides perpendicular adjustment positioning of the sensory device 40 to the main mounting unit itself 1A. A collar 25 located on the sensory device 40's appropriate mounting hardware 10 disallows for rotational movement of the sensory device 40 on its mounting hardware 10. Engagement of the collar 25 against the bottom of the sensory device 40 is achieved by means of turning the collar 25 in a counter-clockwise direction until acceptable friction is applied. A plurality of holes 5 are located around the circumference of the main mounting unit 1A which are utilized during further installation processes. In one embodiment, the plurality of holes 5 can be grommets, rings, or eyelets exhibiting vibration-absorbing, vibration-damping, or noise suppressing capability. Preferably, the grommets, rings, or eyelets 5 are made of neoprene, rubber or other like vibrational damping material.

Figure 3:
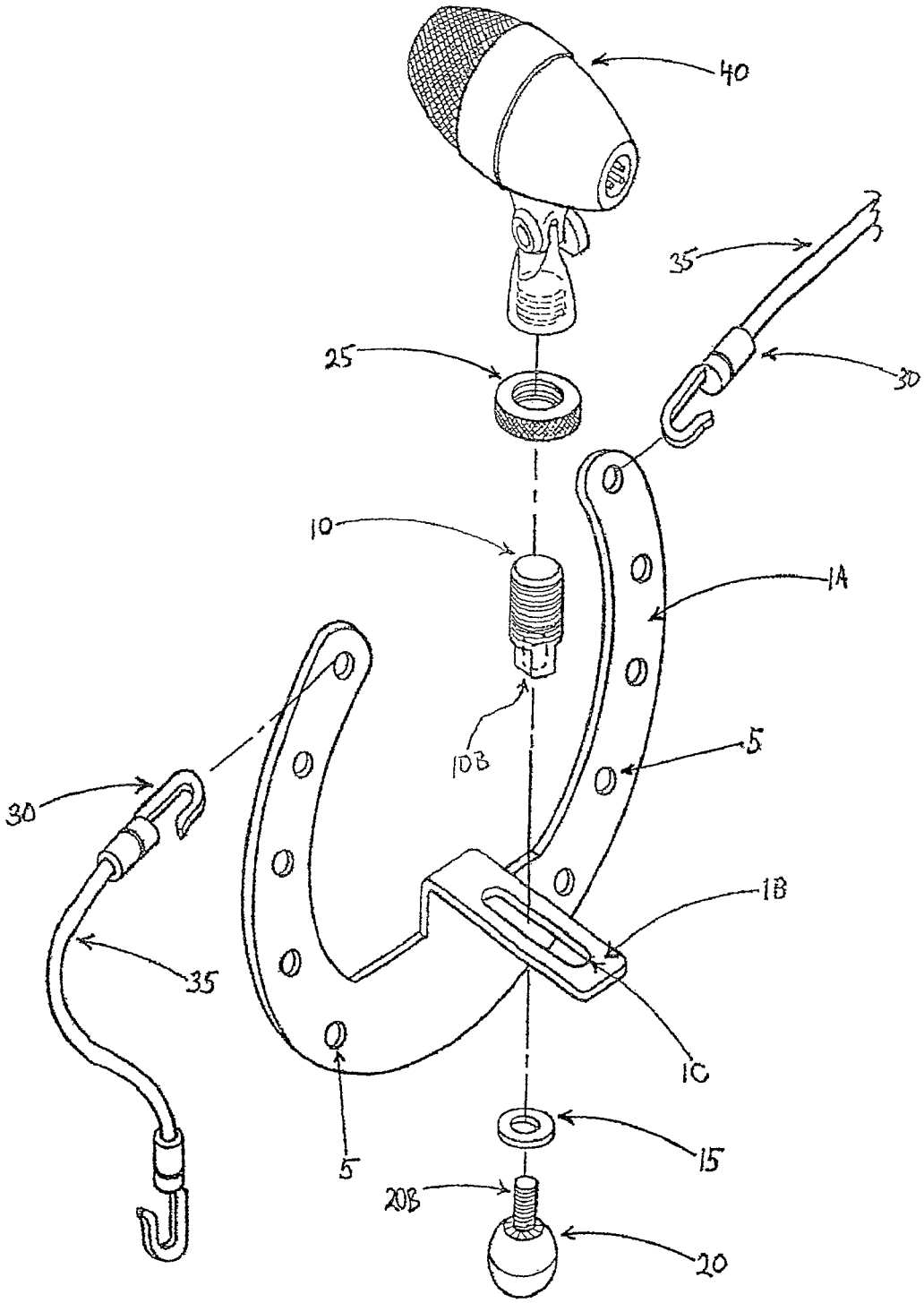
FIG. 3 is an exploded perspective view of the microphone and holder for mounting the same in accordance with one embodiment of the present invention.

FIG. 3 illustrates an exploded view of an embodiment of the present invention and is shown with an industry-standard sensory device 40 for illustrative purposes. 1A is the main mounting unit. The mounting tab 1B may be either a continuation of the main mounting unit 1A bent under pressure to 90 degrees during manufacture, or a separate piece attached at 90 degrees to the main mounting unit 1A. In either case, the mounting tab 1B offers a slot 1C which allows for perpendicular positioning adjustment of the sensory device 40. A locking collar 25 is provided as means of a jam nut, which screws onto the threaded post 10 before the supported device 40 is attached to the threaded post 10. The locking collar 25 is tightened against the supported device 40 to hold the device in place once it has been threaded onto the post. The installer will obtain the desired placement of the sensory device 40 or microphone's direction and tighten the locking collar 25 against the bottom side of the supported device 40 by means of turning the collar 25 backward until it engages the device 40, with friction then holding the direction of the microphone 40 securely in place. This piece 25 too, should be constructed of a durable material such as steel or composites. A bolt, thumbscrew or screw 20B is the means of fastener which passes through the slot 1C and engages the threads on the threaded post 10, thus attaching both components to the main mounting assembly 1. The bolt 20B may be solid metal, or a combination of steel and composites which would form a thumbscrew type knob 20 on the end opposite the threads, for ease of use as is shown in the drawings. A flat or lock washer 15 is located between the fastener and horizontal extension. Friction produced by tightening the bolt; or thumbscrew 20B into the threaded post 10 will retain the threaded post 10 in position along the distance of the slot 1C. The sensory device 40 will be mounted on the mounting tab 1B by being matched to its appropriate mounting hardware 10. A collar 25 located on the sensory device 40's appropriate mounting hardware 10 disallows for rotational movement of the sensory device 40 on its mounting hardware 10. Engagement of the collar 25 against the bottom of the sensory device 40 is achieved by means of turning the collar 25 in a counter-clockwise direction until acceptable friction is applied. The mounting hardware 10 engages the slot 1C and is held in place by means of a thumbscrew 20 whose threaded post 20B is engaged into a threaded hole 10B provided in the bottom of the mounting hardware 10. A washer 15 is located between the thumbscrew 20 and the mounting tab 1B. Located around the circumference of the main mounting unit 1A are a plurality of holes 5 which will allow for engagement of the hooks 35 with the main mounting unit 1A. The hooks 30 are located on both ends of the elastomer cords 35, in which one hook 35 is engaged into any of the holes 5 located on the main mounting unit 1A. The hook 30 on the other end of the elastomer cord 35 is utilized during further installation of the main mounting unit 1A.

Figure 4:
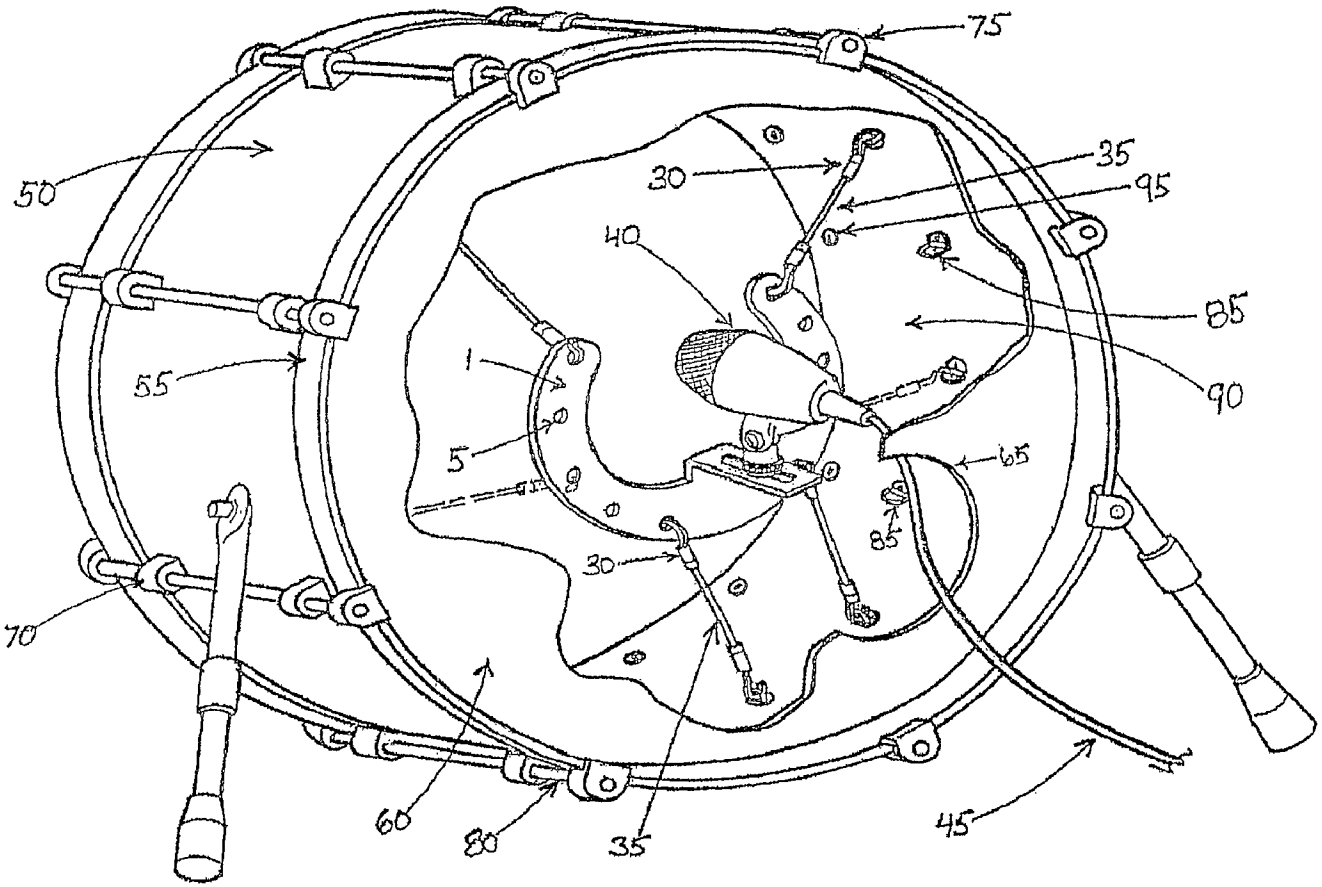
FIG. 4 is a fragmentary perspective view of a portion of the holder in accordance with one embodiment of the present invention.

FIG. 4 illustrates one embodiment of the present invention comprising the main mounting unit 1 inside a standard drum shell 50 with the drumhead 60 opposite the striking surface of said drum being shown in cut-away. The main mounting unit 1, with the sensory device 40 attached, is housed inside the drum shell 50. The main mounting unit 1 is supported inside the drum shell 50 by means of the elastomer cords 35. One end of the elastomer cords 35 engages the main mounting unit 1 by utilizing a hook 30 which is passed through the user's choice of holes 5 present in plurality around the circumference of the main mounting unit 1. The other end of the elastomer cord 35 and hook 30 engages into any of the loops 85 which are installed on the inside of the drum shell 90. These loops 85 are held in place on the inside of the drum shell 90 by the drum's existing tuning hardware 70 screws or bolts 95. The sensory device 40's signal transmission cable 45 passes through a port 65 which is present in the drumhead 60. The drumhead 60 is held in place on the drum shell 50 by means of friction between the tuning hoop 55 and the drum shell 50. The tuning hoop 55 is provided inward pressure by the hoop retainers 75 and tuning lugs 80, which are engaged by means of threads into the tuning hardware 70.

Figure 5:
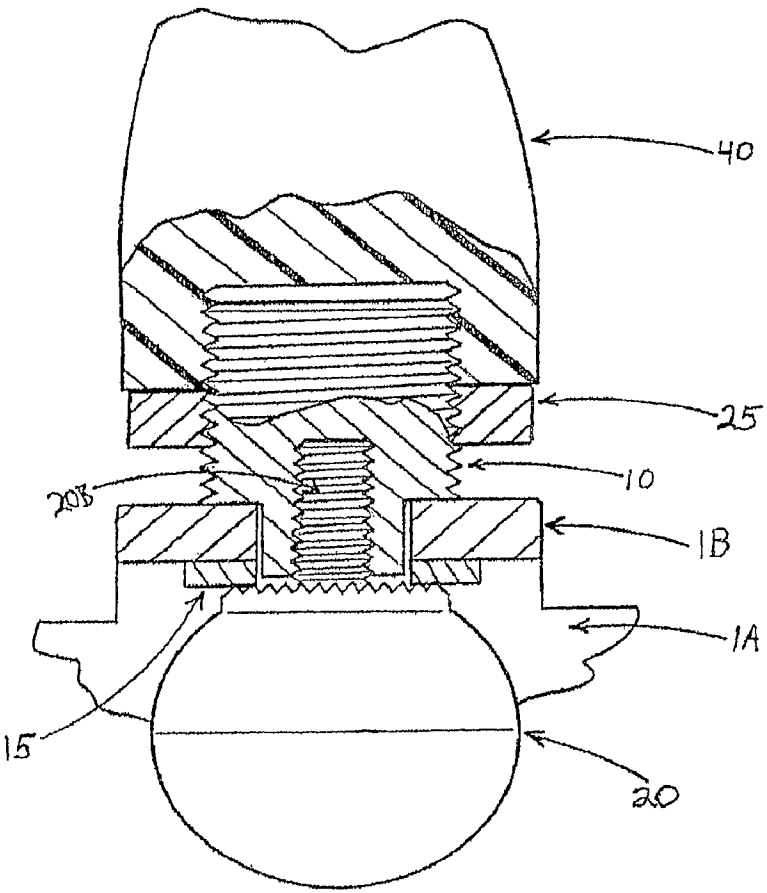
FIG. 5 is a partial sectional view of a portion of the holder in accordance with one embodiment of the present invention.

FIG. 5 illustrates a cross-sectional view of the mating of the sensory device 40 to the mounting tab 1B and the main mounting unit 1A. The mounting tab 1B may be either a continuation of the main mounting unit 1A bent under pressure to 90 degrees during manufacture, or a separate piece attached at 90 degrees to the main mounting unit 1A. A thumbscrew 20 with a threaded post 20B is engaged into threads located in the bottom of the appropriate mounting hardware 10. A washer 15 is located on the threaded post 20B of the thumbscrew 20. A collar 25 located on the sensory device 40's appropriate mounting hardware 10 disallows for rotational movement of the sensory device 40 on its mounting hardware 10. Engagement of the collar 25 against the bottom of the sensory device 40 is achieved by means of turning the collar 25 in a counter-clockwise direction until acceptable friction is applied.

Figure 6:
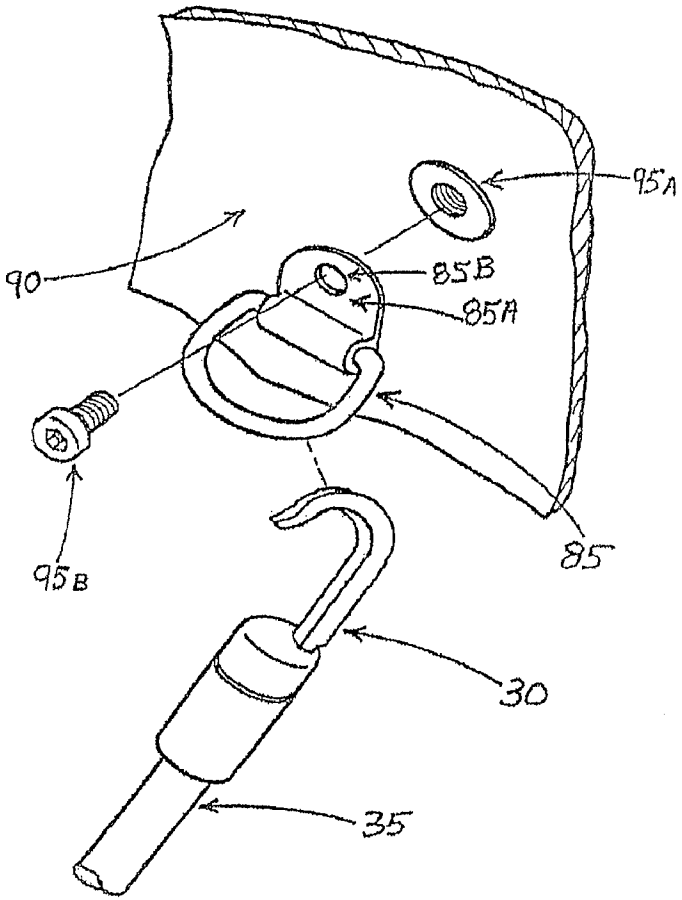
FIG. 6 is a fragmentary perspective view of a portion of the elastomer cords and the drum in accordance with second embodiment of the present invention.

FIG. 6 illustrates an embodiment of the present invention comprising the loops 85 to the inside of the drum shell 90. These loops 85 will be located in plurality around the inside circumference of said drum shell 90. The loops 85 are provided as means of attachment for the hooks 30 which are located on the ends of the elastomer cords 35. The loops 85 are installed by removing the tuning hardware bolts 95B from their threaded receiver 95A, both of which are present around the inside of the drum shell 90. The tuning hardware bolt 95B is then passed through the provided hole 85B in the tab 85A of the loop 85. A washer 95C can be added between the tuning hardware bolts 95B and the support cord loop 85. One or more of these loops 85 must be installed around the interior surface of the drum shell 90 in order to achieve proper installation of the present invention in this particular embodiment. In one embodiment, the loop 85 are made of durable material, including, but not limited to, synthetic plastic, leather, and/or metal.

Figure 7:
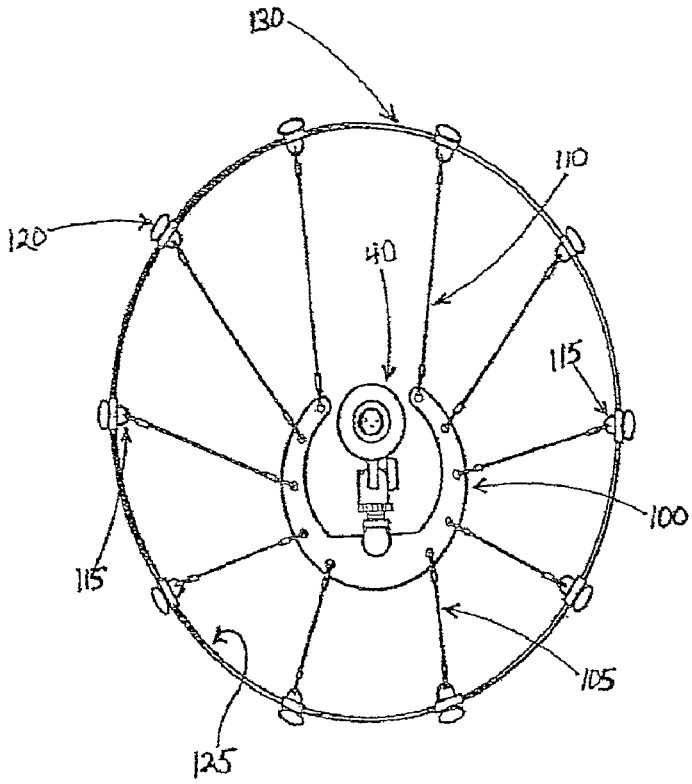
FIG. 7 is a fragmentary front side view of the microphone mounted on the holder in accordance with second embodiment of the present invention, showing one configuration of the elastomer cords.

FIG. 7 illustrates a further embodiment of the present invention. In this embodiment, the main mounting unit 100 with its sensory device 40 attached is installed vertically inside the drum shell 130. Provided as means of installation of the invention, are a plurality of loops 115 located around the inside circumference of said drum shell 125. These loops 115 are installed into the drum's existing tuning hardware 120 as per the description provided by FIG. 6. Desired placement of the sensory device 40 is achieved by utilizing the shorter elastomer cord/hook assemblies 105, and the longer elastomer cord/hook assemblies 110 in any succession chosen by the user. FIG. 7 demonstrates the sensory device 40 being mounted upright and centered in conjunction with the interior of the drum shell 130.

Figure 8:
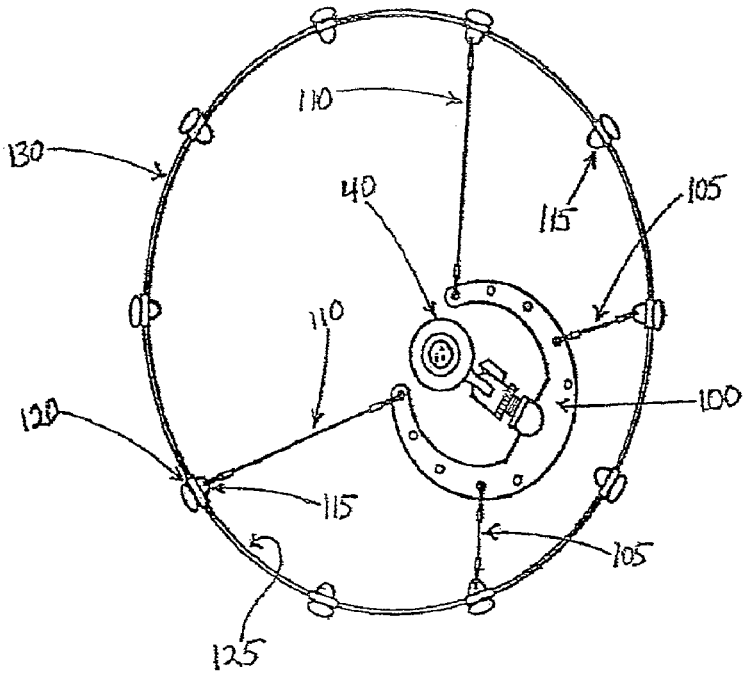
FIG. 8 is a fragmentary front side view of the microphone mounted on the holder in accordance with second embodiment of the present invention, showing another configuration of the elastomer cords.

FIG. 8 illustrates a further embodiment of the present invention. The main mounting unit 100 with its sensory device 40 attached is installed diagonally inside the drum shell 130. Provided as means of installation of the invention, are a plurality of loops 115 located around the inside circumference of said drum shell 125. These loops 115 are installed into the drum's existing tuning hardware 120 as per the description provided by FIG. 6. Desired placement of the sensory device 40 is achieved by utilizing the shorter elastomer cord/hook assemblies 105, and the longer elastomer cord/hook assemblies 110 in any succession chosen by the user. FIG. 8 demonstrates the sensory device 40 being mounted upright and diagonally, slightly off-center in conjunction with the interior of the drum shell 130.

Figure 9:
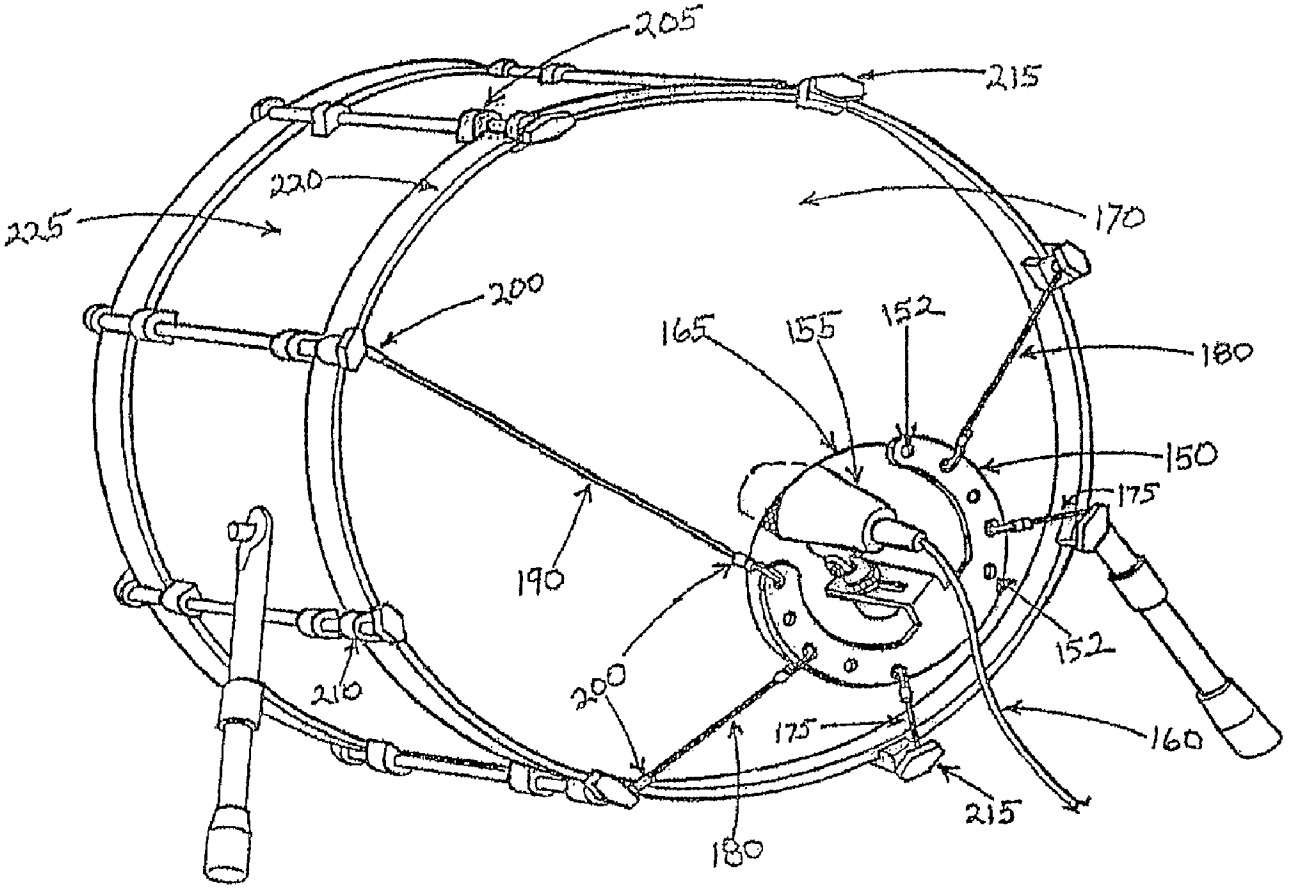
FIG. 9 is a perspective view of the drum and microphone mounted onto the holder constructed in accordance with one embodiment of the present invention.

FIG. 9 illustrates another embodiment of the present invention. In this embodiment, the invention is mounted on the outside of the drum 225, the end opposite the striking surface and forward of the drum head tuning hoop 220. The main mounting unit 150, with its sensory device 155 attached is positioned over the sound port 165 located in the front drum head 170. Desired placement of the sensory device 155 can be achieved by utilizing short elastomer cords 175, medium-length elastomer cords 180 and longer elastomer cords 190, all of which have hooks 200 on both ends. The hooks 200 on one end of the elastomer straps 175, 180, 190 engage into the holes 152 provided around the circumference of the main mounting unit 150. The hooks 200 on the end opposite the main mounting unit 150 of the elastomer cords 175, 180, 190, are then engaged around the tuning lugs 215 of the user's choice to achieve and retain placement of the sensory device 155 to the sound port 165 of the front drum head 170. The tuning lugs 215 operate normally in conjunction with the hoop retainers 210 and tuning hardware 205 to properly apply the desired tuning pressure to the front drum head 170. The sensory device 155's signal transmission cable 160 is then connected to the sound processing equipment which is being utilized by the user.

Figure 10:
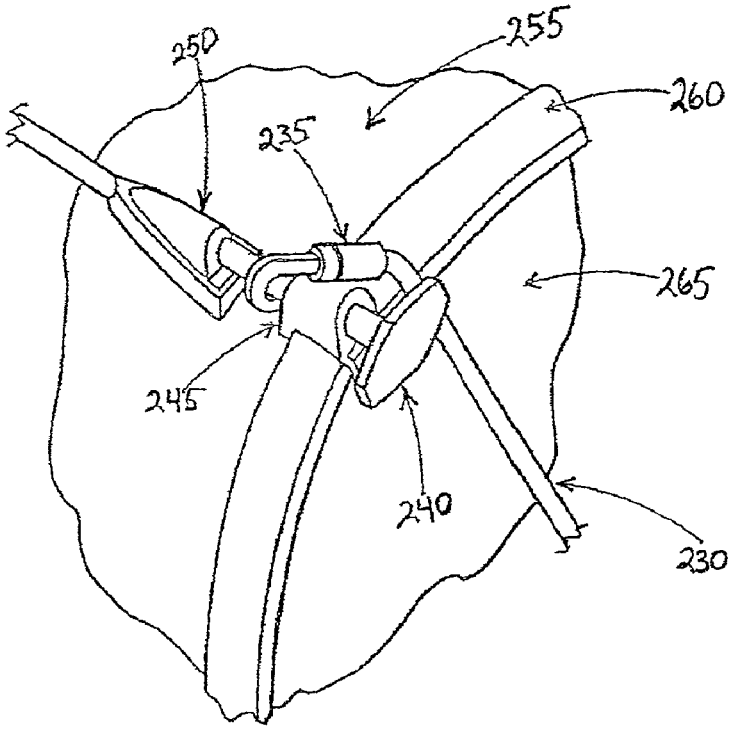
FIG. 10 is a fragmentary perspective view of a portion of the drum and elastomer cords, showing an engagement of the elastomer cords with the tuning lug assembly, in accordance with one embodiment of the present invention.

FIG. 10 illustrates one preferred embodiment for attaching the elastomer cord hooks 235 to the instrument 255. In this illustration, the elastomer cords 230, which provide support for the present invention, are attached directly around the shaft of the tuning lug 240 by means of the hook 235. The hook 235 may be engaged upon the shaft of the tuning lug 240, between the hoop retainer 245 and the tuning hardware 250 at any available space naturally provided by the tuning lug 240. The hoop 260 will provide tension upon the drum head 265 in a normal fashion when this method of attachment is undertaken.

Figure 11:
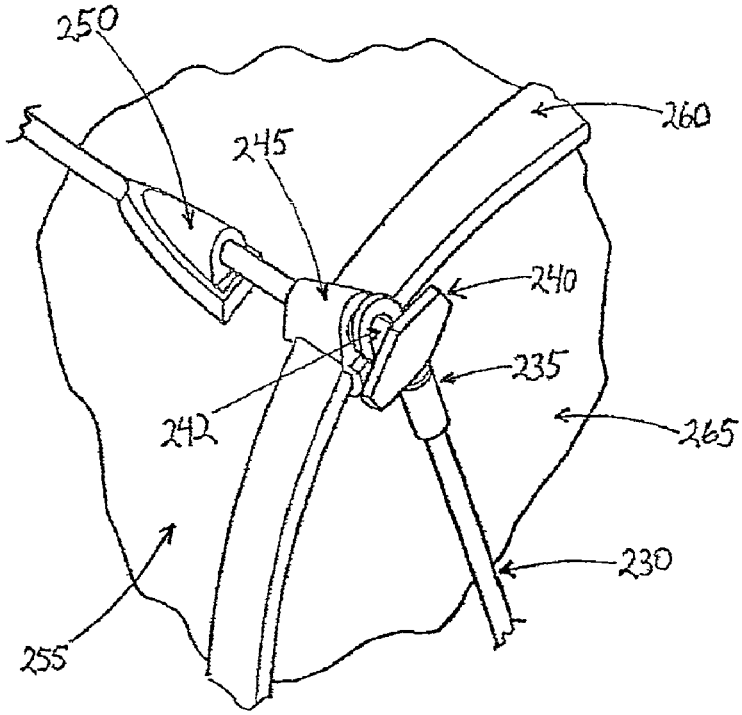
FIG. 11 is a fragmentary perspective view of a portion of the drum and elastomer cords, showing an engagement of the elastomer cords with the tuning lug assembly, in accordance with another embodiment of the present invention.

FIG. 11 illustrates a preferred embodiment for attaching the elastomer cord hooks 235 to the instrument 255. Typically the tuning lug 240 will have enough available threads to allow for the installation of a spacer 242 being placed between the tuning lug 240 and the hoop retainer 245. In this illustration, the elastomer chords 230 which provide support for the present invention, are attached directly around the spacer 242, which the shaft of the tuning lug 240 passes through. The hook 235 may be engaged upon the shaft of the tuning lug 240, forward of the hoop retainer 245 and around the spacer 242. The hoop 260 will provide tension upon the drum head 265 in a normal fashion when this method of attachment is undertaken.

Figure 12:
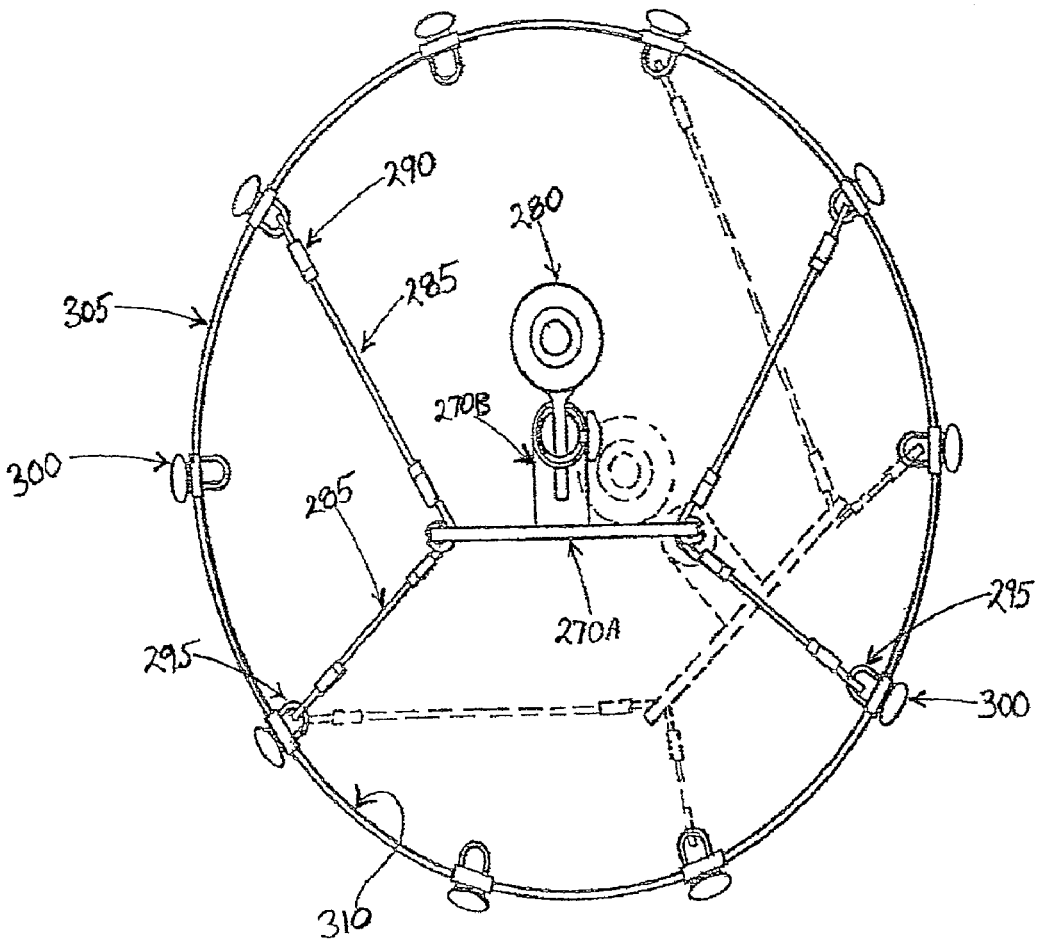
FIG. 12 is a fragmentary front side view of the microphone mounted on the holder in accordance with second embodiment of the present invention, showing one configuration of the elastomer cords.

FIG. 12 illustrates a further embodiment of the present invention being mounted on the inside of the drum 305. The main mounting unit 270A is secured in a horizontal position on the interior of the drum 305, with the mounting tab 270B then being in a vertical position. The desired placement of the sensory device 280 is determined by varying lengths of the elastomer cords 285 and hook 290 assemblies. Provided as means of installation of the invention, are a plurality of loops 295 located around the inside circumference of said drum shell 310. These loops 295 are installed into the drum's existing tuning hardware 300 as per the description provided by FIG. 6. The desired length of elastomer cord 285 is then engaged by means of the hook 285 to the installed loops 295. The main mounting unit 270A, 270B may be adjusted to suit the user's placement preferences of the sensory device 280 by adjusting the length of the elastomer cords 285.

Figure 13:
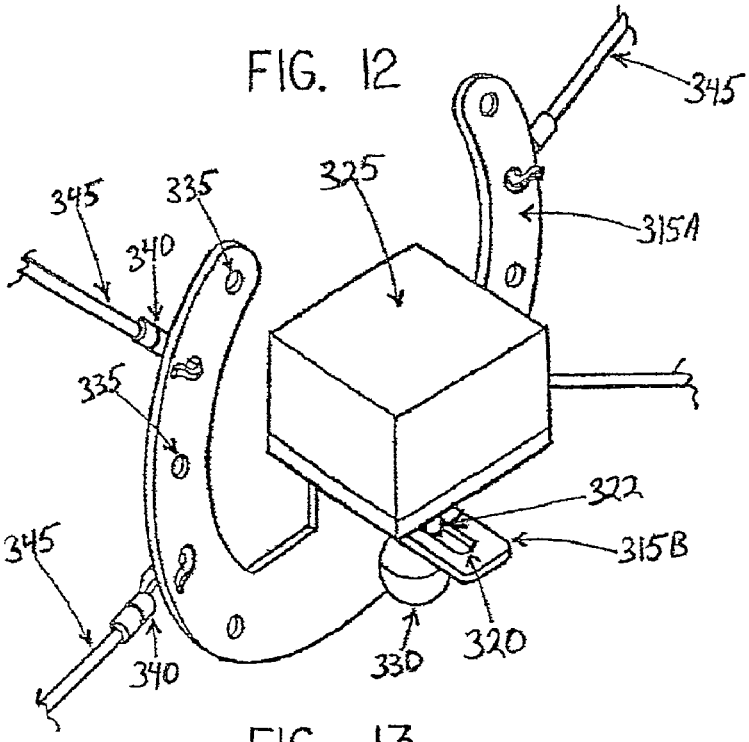
FIG. 13 is a fragmentary perspective view of a portion of the holder assembly in accordance with one embodiment of the present invention.

FIG. 13 illustrates a further embodiment of the present invention comprising a combination of the main mounting unit 315A and a device 325 which is able to be securely supported by the main mounting unit 315A. The device 325 is mated with its appropriate mounting hardware 322, which is attached to the mounting tab 315B by utilizing friction provided by the thumbscrew 330. The slot 320 in the mounting tab 315B provides perpendicular adjustment positioning of the device 325 to the main mounting unit itself 315A. A plurality of holes 335 are located around the circumference of the main mounting unit 315A which provides means of attachment of the hooks 340 to the main mounting unit 315A. The elastomer cords 345 attach to any suitable surface by either spanning the circumference of said suitable surface and re-engaging into the main mounting unit holes 335 by means of an additional hook 340 located on the other end of the elastomer cord 345 or dead-ending to an attachment point.

Figure 14:
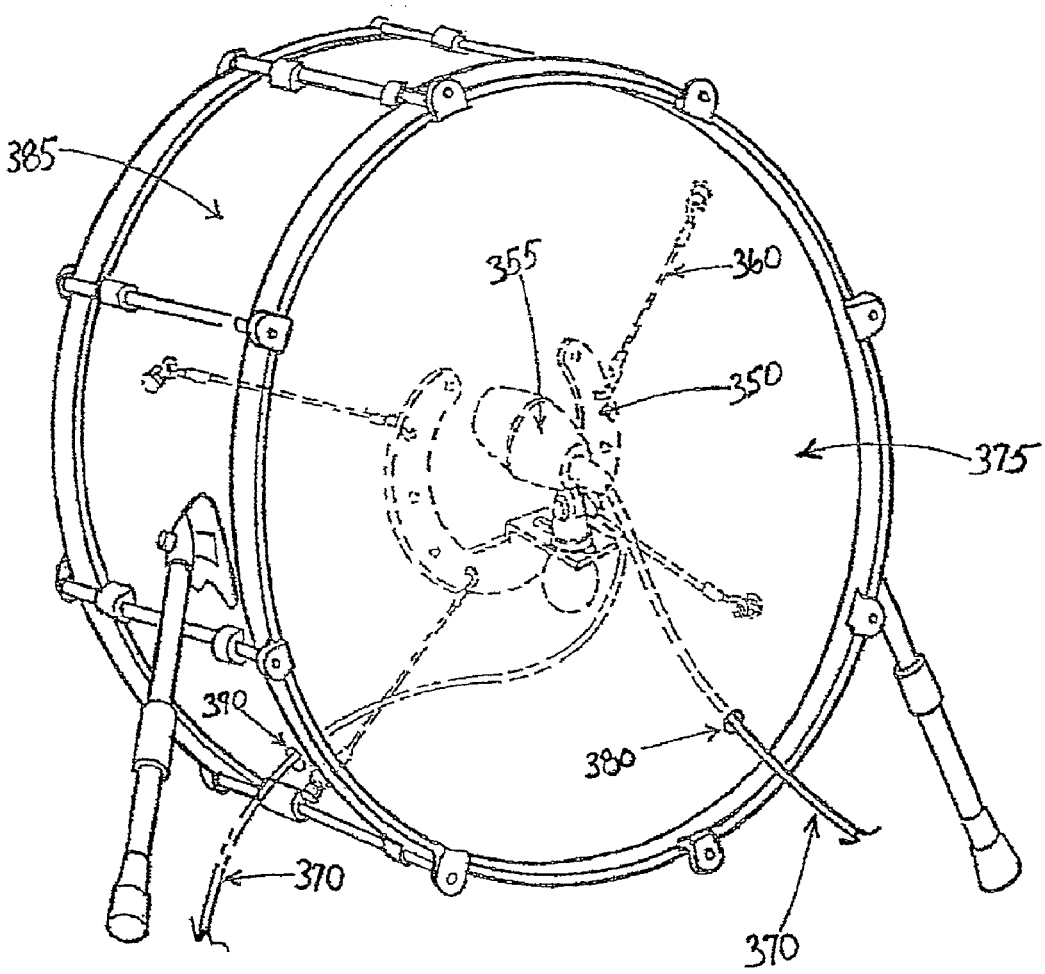
FIG. 14 is a perspective view of a drum and microphone mounted onto the holder in accordance with one embodiment of the present invention.

FIG. 14 illustrates access of the sensory device 355's signal transmission cable to the interior of the drum 385. In this illustration, the main mounting unit 350 is installed on the interior of the drum shell 385 as per the description provided in FIG. 4. In some cases, it is desirable that the drum head 375 opposite the striking surface be as complete a surface as possible. The user penetrates the drum head 375 with a minimum-diameter hole 380 to allow access of the signal transmission cable 370 to the sensory device 385. The user may find it desirable to avoid penetrating the front drum head 375 with a hole 380, so the alternative is creating a minimum-diameter access hole 390 in the drum shell 385 to allow access of the signal transmission cable 370 to the sensory device 355.

Figure 15:
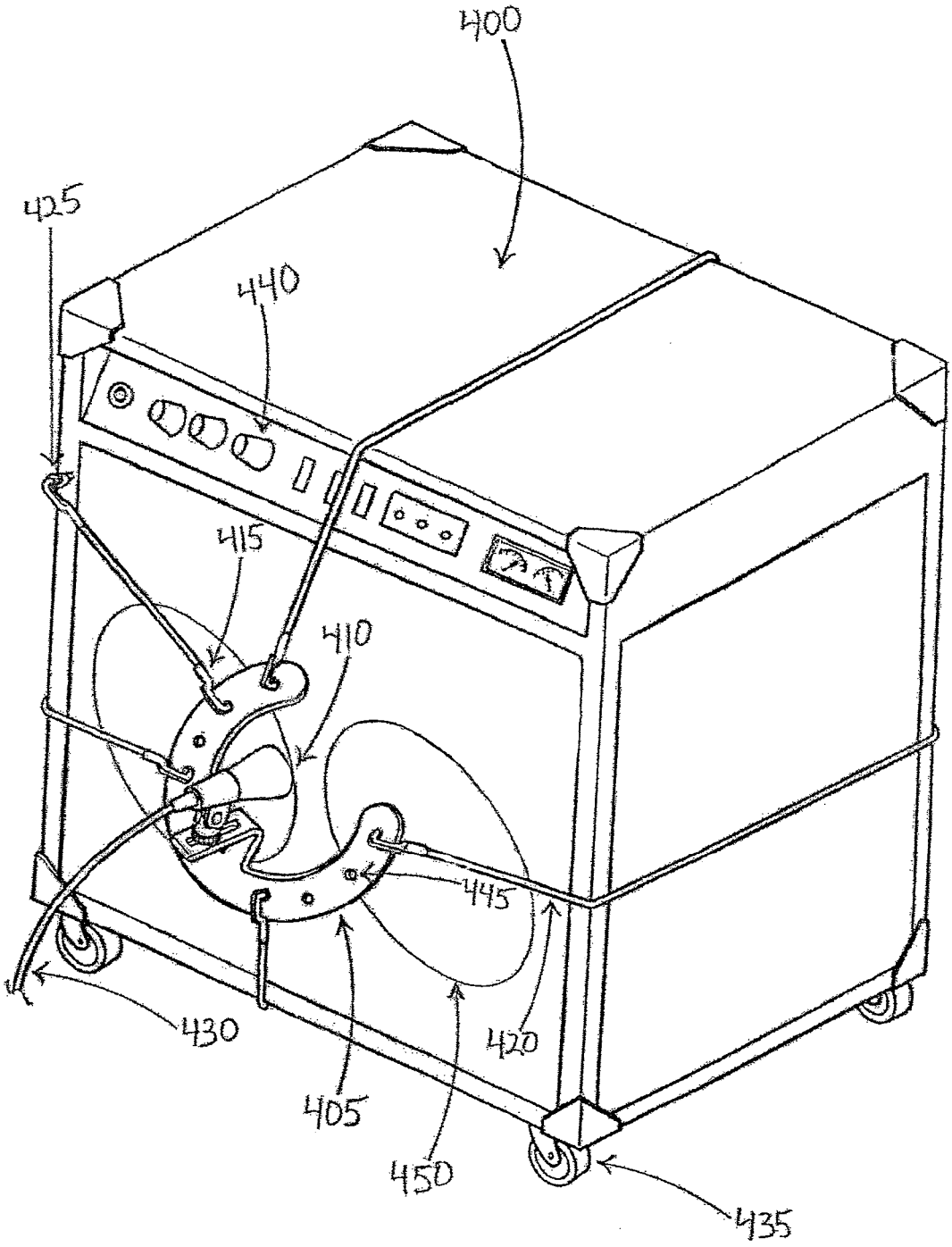
FIG. 15 is a perspective view of a speaker cabinet and microphone with a holder for mounting the microphone constricted in accordance with further embodiment of the present invention.

FIG. 15 illustrates another embodiment of the present invention when it desirable to stabilize a microphone or other sensory device in close proximity to the acoustical speaker 450 which are present inside common amplifier 400. Although the invention is used primarily to stabilize a sensory device in accordance with a musical instrument, the present invention may also be utilized to stabilize a sensory device with other sound device, such as an amplifier or speaker cabinet used to amplify the signal produced by a guitar, bass guitar, keyboard, brass or woodwind instruments, human voice or any other instrument which the user desires to be amplified. The amplifier 400 may or may not include electronic controls 440 or casters 435. In either case, the main mounting unit 405 is positioned in the user's desired location to allow for the microphone or sensory device 410 to capture the acoustic signal and send the signal for further processing via the device cable 430. The main mounting unit 405 is held in place by the elastomer cords 420 which are either wrapped around the entire circumstance of the speaker cabinet 400, or terminate at elastomer cord hooks 415. The main mounting unit 405 is position adjustable by engaging the elastomer cord hooks 415 into the chosen holes 445 which are present in plurality around the outside circumstance of the main mounting unit 405. The length, position and strength of the elastomer support cords 420 will determine and maintain the position of the sensory device 410 in relation to the speaker drivers 450 whose signal is desired to be processed.

While the invention has, been described with reference to specific embodiment chosen for purpose of illustration, it should be apparent that numerous modifications could be made there to by those skilled in the art without departing from the basic concept and scope of the invention.

The terminology used in the description of the invention herein is for the purpose of describing particular embodiments only and is not intended to be limiting of the invention. As used in the description of the embodiments of the invention and the appended claims, the singular forms "a", "an" and "the" are intended to include the plural forms as well, unless the context clearly indicates otherwise.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that relative terms are intended to encompass different orientations of the device in addition to the orientation depicted in the Figures.

Moreover, it will be understood that although the terms first and second are used herein to describe various features, elements, regions, layers and/or sections, these features, elements, regions, layers and/or sections should not be limited by these terms. These terms are only used to distinguish one feature, element, region, layer or section from another feature, element, region, layer or section. Thus, a first feature, element, region, layer or section discussed below could be termed a second feature, element, region, layer or section, and similarly, a second without departing from the teachings of the present invention.

It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Further, as used herein the term "plurality" refers to at least two elements. Additionally, like numbers refer to like elements throughout.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow. The scope of the disclosure is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. Section 112, sixth paragraph, unless the element is expressly recited using the phrase "means for" or, in the case of a method claim, the element is recited using the phrase "step for."

What is claimed is:

1. A holder for mounting a sensory device to a musical instrument, the holder comprising:

a bracket having a mounting portion with a plurality of first connector elements, and a mounting plate arranged at about a 90° angle to the mounting portion the mounting plate being adapted to support the sensory device;

a locking mechanism adapted for fixing said sensory device to said bracket; and a plurality of hanger members, each of the hanger members connecting at least one of said first connector elements to at least one of a plurality of second connector elements attached to the musical instrument, the second connector elements being spaced apart from each other, the hanger members holding said bracket at a predetermined position;

wherein each of said hanger members comprises a shock-absorbing elastomeric strap, and said mounting portion is infinitely adjustable within a plane parallel to a face of the instrument between a plurality of fixed stable positions.

2. The holder as set forth in claim 1 wherein said mounting plate comprises a slot whereby said sensory device is adjustably mounted to the mounting plate.

3. The holder as set forth in claim 1 wherein said first connector elements comprise holes, each of said hanger members being releasably retained by at least one of said holes.

4. The holder as set forth in claim 1 wherein said locking mechanism comprises a threaded member adapted to attach said sensory device to said bracket.

5. The holder as set forth in claim 1 wherein said locking mechanism comprises a locking knob, wherein said locking knob operates in a locked position in which said locking knob engages at least one of said sensory device or an intermediate threaded member and holds said sensory device in position and in a release position in which the sensory device is allowed to be detached.

6. The holder as set forth in claim 1 wherein said locking mechanism further comprises a collar, the collar engaging the bottom portion of said sensory device and said bracket.

7. The holder as set forth in claim 1 wherein each of said hanger members further comprises a hook at one end of said hanger member, the hook being engaged with a respective said first connector element.

8. The holder as set forth in claim 1 wherein each of said hanger members further comprises a hook adjacent one end of said hanger member, the hook being engaged with a respective said second connector element.

9. The holder as set forth in claim 1 wherein each of said second connector elements comprises a tuning lug of said musical instrument, the tuning lug being engaged with a respective said hanger member.

10. The holder as set forth in claim 1 wherein each of said second connector elements comprises a tuning lug of said musical instrument, each of said hanger members being engaged with a respective shaft portion of said tuning lug.

11. The holder as set forth in claim 1 wherein said musical instrument is a drum and comprises a plurality of tuning assemblies attached to the drum by hoop retainers, each of the tuning assemblies including a tuning lug and a spacer disposed between the tuning lug and the hoop retainer, wherein each of said hanger members being engaged with a portion of a respective said tuning assembly.

12. The holder as set forth in claim 1 wherein each of said second connector elements comprises an eyelet, the eyelet being engaged with respective said hanger members.

13. The holder as set forth in claim 1 wherein said bracket is capable of being held at different predetermined positions by changing lengths of said hanger members.

14. The holder as set forth in claim 1 wherein the musical instrument is a drum having a hollow drum shell and the bracket is located inside the hollow drum shell.

15. The holder as set forth in claim 1 wherein the bracket is located outside the musical instrument.

16. A holder for mounting a sensory device to a musical instrument, the holder comprising:

a bracket having a plurality of first connector elements, a mounting plate affixed to said bracket at about a 90° angle, the mounting plate being adapted to support the sensory device;

a locking mechanism adapted for fixing said sensory device to said mounting plate; and a plurality of hanger members, each of the hanger members connecting at least one of said first connector elements to at least one of a plurality of second connector elements attached to the musical instrument, the second connector elements being spaced apart from each other, the hanger members holding said bracket at a predetermined position;

wherein each of said hanger members comprises a shock-absorbing elastomeric strap, and said bracket is infinitely adjustable within a plane parallel to a face of the instrument between a plurality of fixed stable positions.

17. A holder assembly for mounting a sensory device to a musical instrument, the holder assembly comprising:

a bracket having a mounting portion with a plurality of first connector elements, and a mounting plate arranged at about a 90° angle to the mounting portion the mounting plate being adapted to support the sensory device;

a locking mechanism for fixing said sensory device to said bracket;

a plurality of second connector elements attached to the musical instrument, the second connector elements being spaced apart each other; and a plurality of hanger members, each of the hanger members connecting at least one of said first connector elements to at least one of said second connector elements, the hanger members holding said bracket at a predetermined position;

wherein each of said hanger members comprises a shock-absorbing elastomeric strap, and said bracket is infinitely adjustable within a plane parallel to a face of the instrument between a plurality of fixed stable positions.

18. The holder as set forth in claim 17 wherein said mounting plate comprises a slot whereby said sensory device is adjustably mounted to the mounting plate.

19. The holder as set forth in claim 17 wherein said first connector elements comprise holes, each of said hanger members being releasably retained by at least one of said holes.

20. The holder as set forth in claim 17 wherein said locking mechanism comprises a threaded member adapted to attach said sensory device to said bracket.

21. The holder as set forth in claim 17 wherein said locking mechanism comprises a locking knob, wherein said locking knob operates in a locked position in which said locking knob engages at least one of said sensory device or an intermediate threaded member and holds said sensory device in position and in a release position in which the sensory device is allowed to be detached.

22. The holder as set forth in claim 17 wherein said locking mechanism further comprises a collar, the collar engaging the bottom portion of said sensory device and said bracket.

23. The holder as set forth in claim 17 wherein each of said hanger members further comprises a hook at one end of said hanger member, the hook being engaged with a respective said first connector element.

24. The holder as set forth in claim 17 wherein each of said hanger members further comprises a hook adjacent one end of said hanger member, the hook being engaged with a respective said second connector element.

25. The holder as set forth in claim 17 wherein each of said second connector elements comprises a tuning lug of said musical instrument, the tuning lug being engaged with a respective said hanger member.

26. The holder as set forth in claim 17 wherein each of said second connector elements comprises a tuning lug of said musical instrument, each of said hanger members being engaged with a respective shaft portion of said tuning lug.

27. The holder as set forth in claim 17 wherein said musical instrument is a drum and comprises a plurality of tuning assemblies attached to the drum by hoop retainers, each of the tuning assemblies including a tuning lug and a spacer disposed between the tuning lug and the hoop retainer, wherein each of said hanger members being engaged with a portion of a respective said tuning assembly.

28. The holder as set forth in claim 17 wherein each of said second connector elements comprises an eyelet, the eyelet being engaged with respective said hanger members.

29. The holder as set forth in claim 17 wherein said bracket may be held at different predetermined positions by changing lengths of said hanger members.

30. The holder as set forth in claim 17 wherein the musical instrument is a drum having a hollow drum shell and the bracket is located inside the hollow drum shell.

31. The holder as set forth in claim 17 wherein the bracket is located outside the musical instrument.

32. A holder for mounting a microphone to a percussion instrument, the holder comprising:

a bracket having a mounting portion with a plurality of first connector elements, and a mounting plate arranged at about a 90° angle to the mounting portion the mounting plate being adapted to support the sensory device;

a locking mechanism adapted for fixing said sensory device to said bracket; and a plurality of hanger members, at least one of the hanger members adapted to be connected to two said first connector elements simultaneously, the hanger members adapted to hold said bracket at a predetermined position relative to the sound producing device;

wherein each of said hanger members comprises a shock-absorbing elastomeric strap, and said bracket is infinitely adjustable within a plane parallel to a face of the sound producing device between a plurality of fixed stable positions, and at least one of said hanger members connecting at least one of said first connector elements to at least one second connector element attached to the sound producing device.

33. The holder as set forth in claim 32 wherein said mounting plate comprises a slot whereby said sensory device is adjustably mounted to the mounting plate.

34. The holder as set forth in claim 32 wherein said first connector elements comprise holes, each of said hanger members being releasably retained by at least one of the holes.

35. The holder as set forth in claim 32 wherein said locking mechanism comprises a threaded member adapted to attach said sensory device to said bracket.

36. The holder as set forth in claim 32 wherein said locking mechanism comprises a locking knob, wherein said locking knob operates in a locked position in which said locking knob engages at least one of said sensory device or an intermediate threaded member and holds said sensory device in position and in a release position in which the sensory device is allowed to be detached.

37. The holder as set forth in claim 32 wherein each of said hanger members further comprises a hook at one end of said hanger member, the hook being engaged with a respective said first connector element.

38. The holder as set forth in claim 37 wherein each of said second connector elements comprises an eyelet, the eyelet being engaged with respective said hanger members.

39. The holder as set forth in claim 32 wherein said bracket may be held at different predetermined positions by changing lengths of said hanger members.

40. The holder as set forth in claim 32 wherein said bracket is capable of being held at different predetermined positions by connecting said hanger member to different set of two said first connector element.

41. The holder as set forth in claim 32, wherein the percussion instrument is a kick drum.

* * * * *